United States Patent [19]

Rushing

[11] Patent Number: 5,053,931

[45] Date of Patent: Oct. 1, 1991

[54] DIFFUSE PATIO LIGHTING ARRANGEMENT

[76] Inventor: John A. Rushing, 1165 Tern Dr., Palatine, Ill. 60067

[21] Appl. No.: 566,487

[22] Filed: Aug. 13, 1990

[51] Int. Cl.[5] ..... A45B 23/00

[52] U.S. Cl. ..... 362/102; 135/910; 362/234; 362/249

[58] Field of Search ..... 362/102, 227, 234, 249, 362/252, 253, 806; 135/DIG. 10, 910

[56] References Cited

U.S. PATENT DOCUMENTS

| | | | |
|---|---|---|---|
| 1,166,272 | 12/1915 | Smithing | 362/102 |
| 2,087,537 | 7/1937 | Finkel | 362/102 |
| 2,453,925 | 11/1948 | Mendonca | 362/123 X |
| 3,036,206 | 5/1962 | Holbrook | 362/806 |
| 3,313,929 | 4/1967 | Schiavone | 362/102 |
| 3,723,723 | 3/1973 | Lerner | 362/249 X |
| 3,870,062 | 3/1975 | Medlin | 362/102 X |
| 4,079,344 | 3/1978 | Lauben et al. | 439/106 X |
| 4,174,532 | 11/1979 | Kelley | 362/102 |
| 4,848,385 | 7/1989 | Pennella | 135/16 |
| 4,860,179 | 8/1989 | Mui et al. | 362/102 |

*Primary Examiner*—Stephen F. Husar

[57] ABSTRACT

A lighting arrangement is provided that is generally useful for a variety of outdoor lighting applications and in particular on patio umbrellas. The lighting has a radial arrangement of the lights that extend from a central connector box. The central connector box allows a multiplicity of light strings to emanate from a single power source. A diffuse and attractive light display is provided by the large number of small lights. A rain resistant cover over the central connector box protects against electrical shock. As an added safety feature the lighting arrangement will usually include a ground fault circuit interrupt device "GFCI" on a central power supply cord to prevent electrical shock. The ground fault interrupt is particularly advantageous when the lighting arrangement is located on conductive materials.

13 Claims, 3 Drawing Sheets

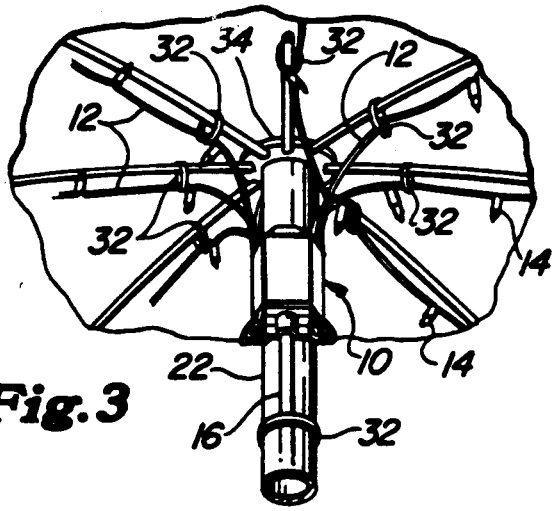
Fig. 3
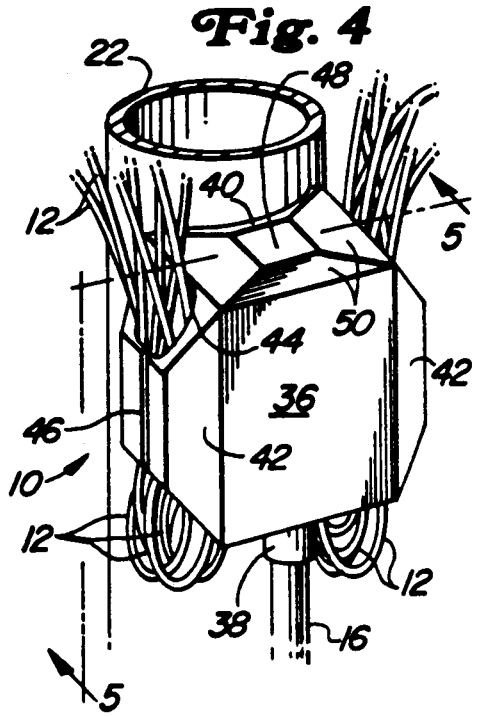
Fig. 4
Fig. 5
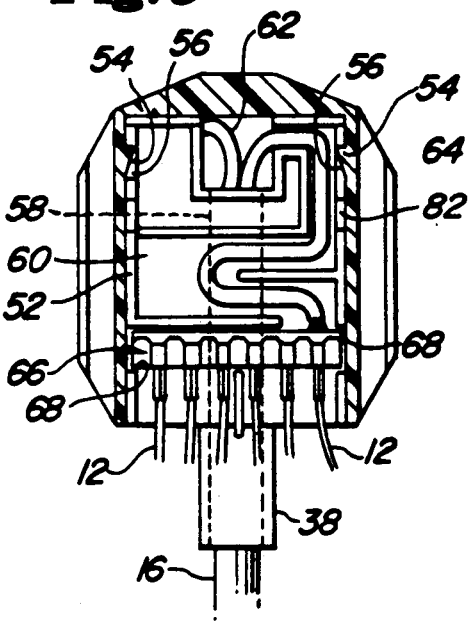
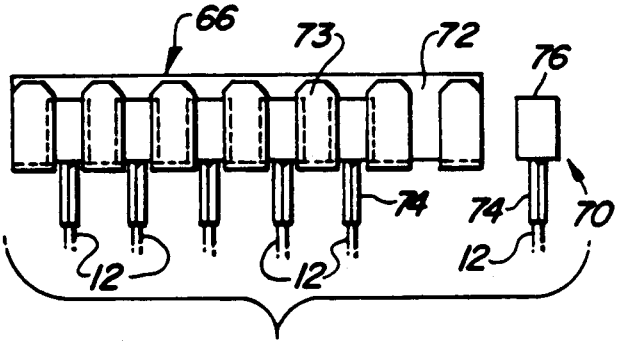
Fig. 7
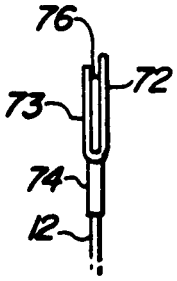
Fig. 8
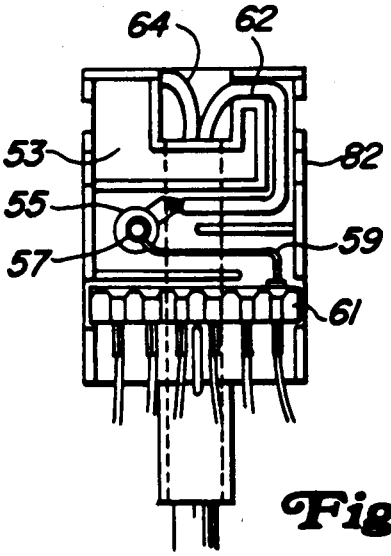
Fig. 6
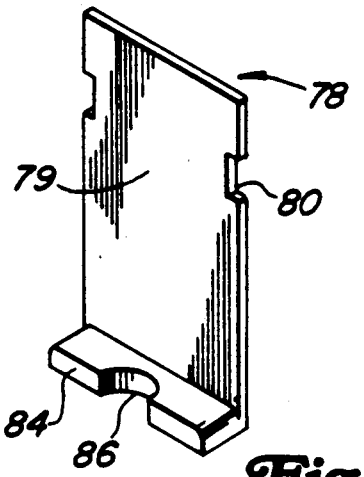
Fig. 9

DIFFUSE PATIO LIGHTING ARRANGEMENT

FIELD OF THE INVENTION

This invention relates to the use of miniature lights. More specifically this invention relates to the outdoor use of miniature lights in a radial arrangement that is suitable for the illumination of an outdoor patio umbrella.

DESCRIPTION OF THE PRIOR ART

Many homes and outdoor entertainment areas have table arrangements with overhead patio umbrellas that are used to shade the sun during the day. Attempts have been made to illuminate these umbrellas at night by the use of different lighting arrangements. Such prior art arrangements include garden umbrellas and patio umbrellas as shown in U.S. Pat. Nos. 2,087,537 issued to Finkel and U.S. Pat. No. 4,174,532 issued to Kelley. Both Finkel and Kelley show the use of three or four incandescent bulbs underneath the top and in the center of a garden umbrella to illuminate the area under the umbrella. U.S. Pat. No. 3,313,929 issued to Schiavone shows a lawn or beach umbrella having a fluorescent light located in the center support pole to illuminate the area underneath the umbrella. A pavilion umbrella, shown in U.S. Pat. No. 3,870,062 issued to Medlin, is similar to Finkel and Kelley in that it uses central incandescent lighting to provide illumination of the umbrella. Medlin is different, however, in that it includes a lower translucent cover that hides the ribs and retracting mechanism of the umbrella. All of these umbrella configurations are characterized by relatively concentrated light that has the aforementione disadvantage of attracting bugs and insects.

Another important consideration in the design of lighting systems for outdoor use in structures such as patio umbrellas is the hazard of electrical shock. Such umbrellas are usually left outside and can become wet. Electrically conductive material are usually used in the construction of such patio umbrellas. The use of household electric current to illuminate the umbrellas can shock someone who comes in contact with improperly grounded parts of the umbrella, umbrella base, or other structures from which the umbrella is supported such as a metal table and chair set. In most of the prior art patio light arrangements that use only a few light bulbs, each light can be effectively insulated to prevent electrical shock. Protecting against electrical shock becomes more difficult as the number of lights that are used to illuminate the umbrella increases.

Other lighting arrangements for umbrellas that use a number of small incandescent light can be found on hand held hand held umbrellas. U.S. Pat. No. 4,848,385 issued to Pennella shows a hand umbrella with a battery operated light at the top of the center stick of the umbrella. U.S. Pat. Nos. 4,860,179 issued to Mui et. al. and U.S. Pat. No. 1,166,272 issued to Smithing show battery operated lights in a hand umbrella at the top and bottom of the umbrella stick and at the ends of the umbrella support ribs. The battery operated systems of these umbrella and the limited lighting provided by the small lights is unsuitable for the illumination of patio type umbrellas.

Arrays of miniature lights that use household current to provide a substantial amount of illumination are also known. Such lighting arrangements have been disclosed for use as Christmas tree decorations. U.S. Pat. No. 3,723,723 issued to Lerner shows a miniature Christmas tree light arrangement having a plurality of light strings arranged with individual lights in series and all of the stings connected in parallel to a central connection block. Another arrangement of multiple strings of Christmas tree lights is shown in U.S. Pat. No. 2,453,925 issued to Mendonca. The arrangement of Mendonca teaches the electrical connection of the light strings to central connector plates which are also connected to a household power cord. The only use described for these light arrangements is on indoor Christmas trees.

It is an object of this invention to provide outdoor illumination that is sufficiently diffuse to prevent the attraction of bugs and insects and designed to prevent shock when mounted on electrically conductive structures such as patio furniture.

A more specific object of this invention is to provide a method and lighting arrangement for the illumination of patio or lawn type umbrellas that provides diffuse light an does not pose a risk of electrical shock.

It is a further object of this invention to provide an attractive and unusual method of illuminating patio and lawn type umbrellas.

A yet further object of this invention is to provide a lighting arrangement that is readily added to a patio or lawn type umbrella and will provide diffuse light without the hazard of electrical shock.

Yet another object of this invention is to provide a connector arrangement that facilities connection of individual light strings in parallel to a common electrical power source.

BRIEF SUMMARY OF THE INVENTION

This invention is an array of miniature lights that consists of separate strands of lights that are connected in parallel to an ordinary household electrical outlet through a power cord and a water resistant central connection box. The multiple strings provide a large number of miniature lights that are sufficient in number to provide illumination, but still diffuse enough to avoid the concentrated light source that will attract insects. The water resistant central connection box minimizes the risk of electrical shock from exposure of the light array to the elements. Electrical shock hazard can be further reduced by the use of ground fault interrupt circuit "GFCI" in the power cord. A particularly beneficial use of the light array is underneath a patio or lawn umbrella where the light strands are secured to the ribs of the umbrella. Use of the system underneath the umbrella provides diffuse and pleasing illumination while the design of the array prevents the hazard of electrical shock.

Accordingly, in one aspect this invention is a lighting apparatus designed for outdoor use in a radially extending pattern. The lighting apparatus has a power supply cord for an electrical outlet, a plurality of miniature light strings with the lights in each string connected in a series circuit, and a central connection box having means for electrically connecting each of the light strings in parallel to the power supply cord. The central connection box includes a cover having water impervious sides and a water impervious top.

In another embodiment this invention is a lighting apparatus for outdoor use in a patio umbrella having radially extending ribs for supporting a covering material. The apparatus includes a power supply cord for an central outlet and a plurality of miniature light strings with the lights in each string connected in a series circuit. Means are provided for securing individual light strings along the length of individual ribs of said umbrella. A central connection box is also provided having means for electrically connecting each of said light strings in parallel with said power supply cord and a cover having water impervious sides and a water impervious top. Means are also provided for securing said central connection box to a center support for said umbrella.

In yet another embodiment this invention is a patio umbrella arrangement for providing diffuse light comprising: a patio umbrella having a center support, a plurality of ribs extending radially outward from an upper section of the center support, and a covering material supported by the ribs; a string of miniature lights connected in a series circuit secured to and extending along each rib; a power supply cord for an electrical outlet; and, a central connection box secured to the center support having means for electrically connecting each of the light strings in parallel with the power supply cord and a cover having water impervious sides and a water impervious top.

BRIEF DESCRIPTION OF THE DRAWINGS

FIG. 3 is a perspective view of a portion of a patio umbrella and portion of the light arrangement of this invention showing the connector box mounted underneath the umbrella.

FIG. 4 is an enlarged perspective view of FIG. 3 showing the connector box of this invention and the umbrella support pole.

FIG. 5 is a sectional view of the connector box of FIG. 4 taken along line 5—5 and showing one face of a terminal block therein.

FIG. 6 is a view of the opposite face of the terminal block of FIG. 5.

FIG. 7 is a plan view of a connector bus removed from the connector box of FIG. 5.

FIG. 8 is a side view of the connector bus of FIG. 7.

FIG. 9 is a perspective view of a shield used that covers the wiring and terminals in the connector box.

DETAILED DESCRIPTION OF THE INVENTION

The lighting arrangement of this invention is generally useful for a variety of outdoor lighting applications. Safety and convenience are provided by the radial arrangement of the lights. The central connector box allows a multiplicity of light strings to emanate from a single power source. A diffuse and attractive light display is provided by the large number of small lights. The rain resistant cover of the central connector box protects against electrical shock. As an added safety feature the lighting arrangement will usually include a "GFCI" on a central power supply cord to prevent electrical shock. The ground fault interrupt is particularly advantageous when the lighting arrangement is located on conductive materials.

Figure 1:
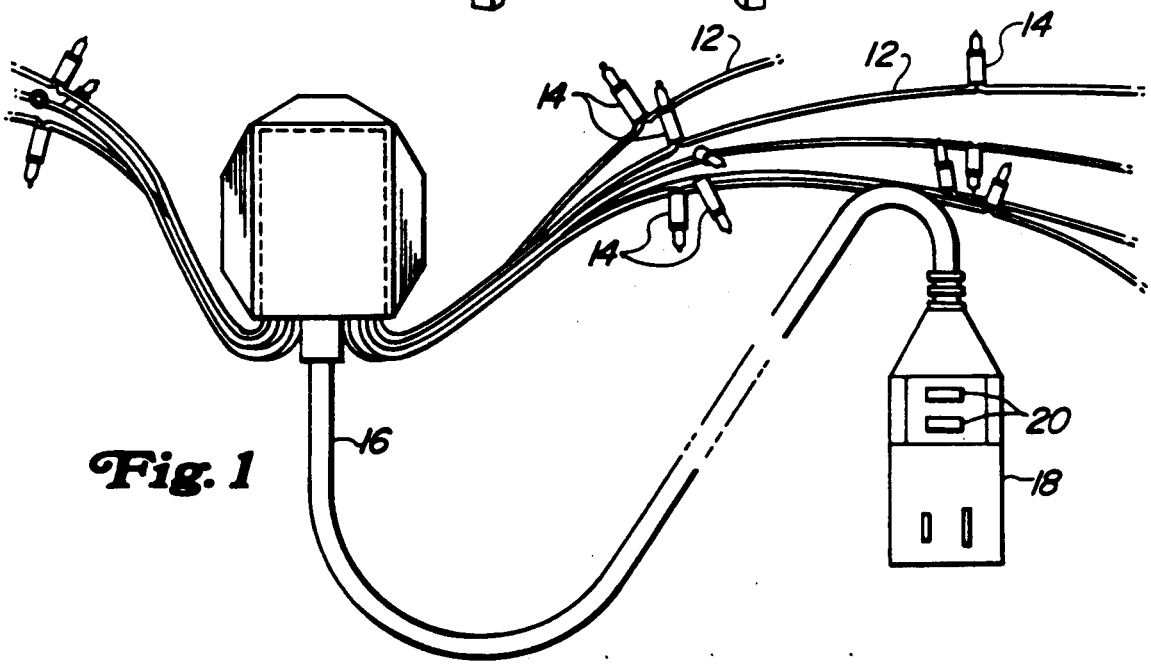
FIG. 1 is a perspective view of the power cord, central connector box and a portion of the light strands for the lighting arrangement of this invention.

The overall form of the lighting arrangement is shown in part by FIG. 1. Basic elements of the lighting arrangement include a central connector box 10, a plurality of wires 12 for light strings that extend from the central connector box and have miniature lights 14 wired thereto, and a single power cord 16 that supplies power to the central connector. Enough lights are provided in each string to provide a spacing of approximately four to eight inches between miniature lights. The power cord is connected to an ordinary household electrical outlet by the two prong plug 18. Manual reset and test buttons 20 are part of the GFCI circuit. Plug 18 has a GFCI incorporated therein. The box connector can supply power to a large number of light strings. Typically there will be from 8 to 12 strings of lights connected to the central connector.

When installed central connector box 10 is located in a vertical position as shown in FIG. 1. All of the light strings 12 and the power cord 16 enter through the bottom of the central connector 10. Connector 10 also has water impervious sides and a water impervious top. Together the water impervious sides and top, and connection of the box connector wiring through its bottom keeps precipitation out of the connector and makes the lighting arrangement water resistant. In addition it is preferred that the box connector be made from materials that are resistant to ultra violet radiation, flame retardant and able to withstand impact at temperatures of less that minus twenty degrees centigrade. Accordingly with these properties the lighting arrangement is suitable for use in most outdoor applications.

Figure 2:
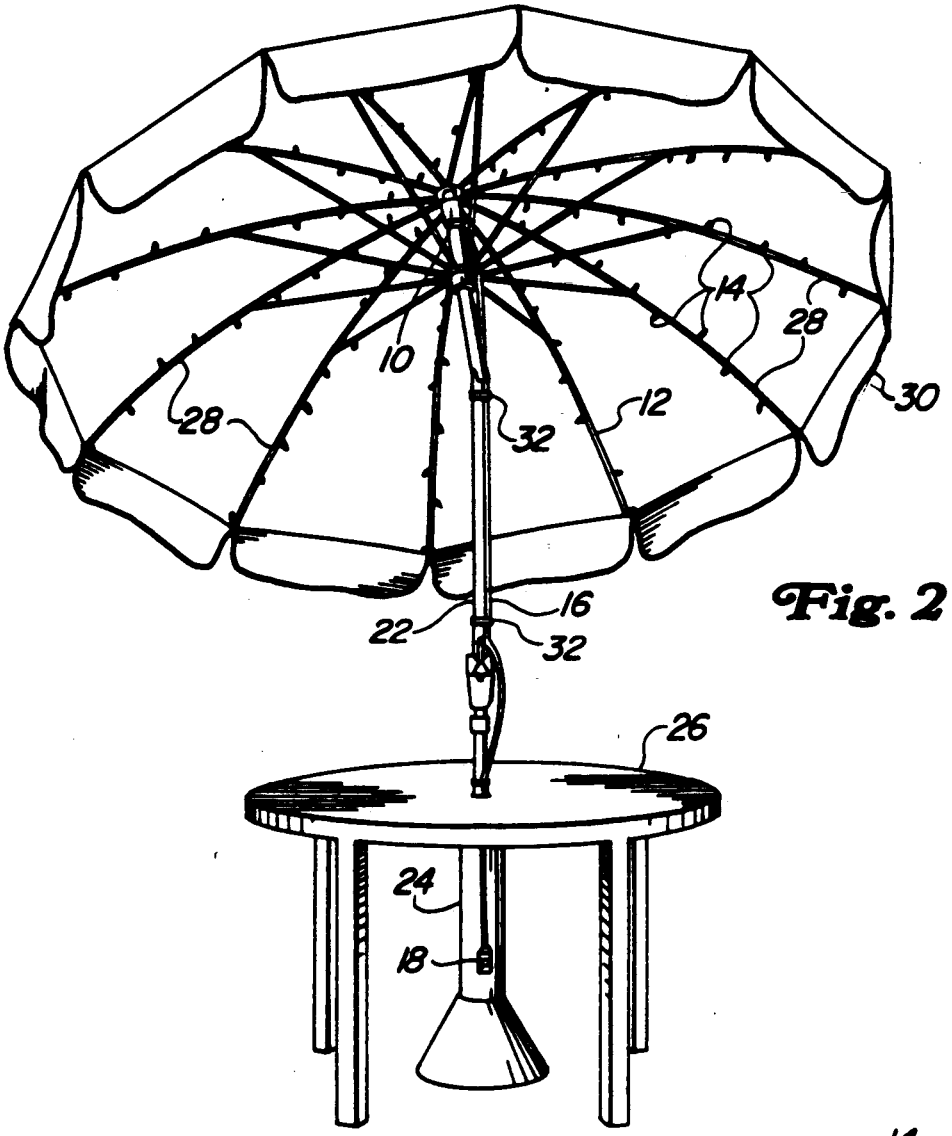
FIG. 2 is a perspective view of the lighting arrangement of this invention on an outdoor patio umbrella

The lighting arrangement is particularly suited for use under an outdoor patio umbrella. Application of the lighting arrangement to such and umbrella is shown in FIG. 2. The patio umbrella has a central support pole 22 for the umbrella that is in turn supported from a central stand 24 and a table 26 through which the pole extends. A set of ribs 28 extend radially from the top of support pole 22. Ribs 28 support a covering material 30 that extends over the top of the umbrella.

The central connector box 10 is mounted to the umbrella at the top of support pole 22. The connector box is located at the top of the support pole to prevent interference of the central connector box with the ribs and resulting damage to the lights, ribs, or connector box when the umbrella is retracted. For most installations the central connector is located approximately three inches form the top of the umbrella. The central connector can be attached to the support pole by any method that will leave it securely mounted thereon. Usually a double sided adhesive strip between the connector and the support pole will provide a suitable attachment.

The power cord 16 extends from the central connector 10 down support pole 22 and through the center hole in table 26 to the bottom of the umbrella base. In order to fit the bulky plug through the center hole in the table the support pole is removed form the table and replaced after the cord has been passed through the hole. Some umbrellas use a center support ring that the borders the hole in the table for the support pole. Additional clearance for the power cord can be obtained by cutting a small section in the ring. The power cord can then be extended through the cutout portion of the support ring. If the center hole of the table is to small to accommodate the power cord 16 in addition to the support pole 22, the power cord may be draped over the table. Preferably cord 16 is kept relatively short so that plug 18 will hang one to two feet below the ground when the light set is installed in the umbrella or other overhead structures. Since an extension cord will usually be used to connect the plug 18 with a household electrical supply, the short length of cord 16 will keep the end of cord 16 out of any standing water.

Individual strands of wire 12 and lights 14 extend down the length of ribs 28 and attached thereto. Although it is not essential for the use of the lighting arrangement, it is preferable that the individual strings of lights will have enough length to extend to the end of the umbrella ribs 28. Therefore, in most applications the lights will have more length than is needed to extend to the end of the ribs. When the length of the strings exceed the rib length, the light string length is easily adjusted by gently twisting the end of the light string until its length matches that of the umbrella rib. Adjusting the light strings in this manner automatically maintains a relatively uniform light spacing along the rib.

The strings of lights may be attached to the ribs and the power cord may be attached to the central support pole by any method. Preferably the light strings and power cord are attached to the ribs and support pole respectively by plastic zip ties 32, other similar light gauge strapping or specially designed clips. The power cord should be strapped to the support pole at several locations to prevent the cord from interfering with the operation of the umbrella or becoming entangled by those using the umbrella. On each rib, the light strings are secured to the beginning and end of each rib and at several points along the length of the rib.

The use of zip ties for the attachment of the light strings and power cord may be seen in more detail in FIG. 3. FIG. 3 shows an enlarged view of the central connector box and a central attachment ring 34 that retains the ribs of the umbrella. Below the central connector box 10 the power cord 16 is secured to the support pole 22 by a zip tie 32. Each of the individual light strings that extend outward from the central connector box are secured to the ribs by a zip tie 32 at a location proximate the central attachment ring 34. The light string is positioned such that the first light in each string is located near the attachment ring 34. Any additional length of wire that is left between the first light of each light string and the central connector can be taken up by looping the wire through storage channels on the side of the connector box.

The light arrangement is designed for a relatively permanent installation. Whether the umbrella is extended or retracted, the connector box 10 can remain in place. The light strings also remain firmly fixed to the ribs of the umbrella. Therefore, once the light arrangement is put up on an umbrella, it stays up.

Figure 10:
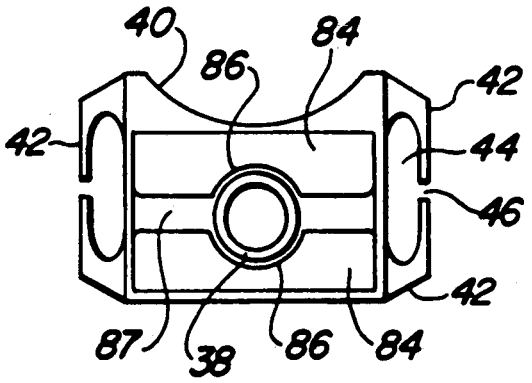
FIG. 10 is a bottom view of the connector box of FIG. 4 with the power cord and wires removed.

A more thorough appreciation of the preferred form of the central connector box including the storage channels can be gained from FIG. 4. FIG. 4 shows the outer cover 36 of the central connector box and a sleeve portion 38 of a terminal block that is located therein. Outer cover 36 is attached to the support pole 22 by an adhesive strip (not shown) in the manner previously described. An arcuate surface 40 is formed on the back of the cover to facilitate its attachment to a round support pole. A pair of wing type members 42 extend out from opposite sides of cover 36 to form a wire storage channel 44 along two sides of the cover 36. A gap between each pair of members 42 forms a slot 46. (Additional details of surface 40 and channels 44 are shown in FIG. 10.) Wires 12 for the light strings extend from the bottom of the central connector box 10 and can be fed through slot 46 for retention in channel 44. In addition to taking up slack from the wires, channels 44 allow the wires to be more neatly and safely retained on the sides of cover 36.

All of the sides of cover 36 and the top 48 of cover 36 are impervious to moisture penetration. In the illustrated embodiment of this invention the cover is molded in a single section to provide the sealed top and sides. The top 48 has pitched borders 50 to drain water from the top of the cover. Providing the cover with water impermeable sides and top shields the inner terminal block from moisture.

The outer cover is sectioned along lines 5—5 to provide a view of the terminal block 52 as shown in FIG. 5. Overall the terminal block is rectangular in shape and slides into a rectangular central cavity of cover 36. Preferably the terminal block will lock into place within the cover after its assembly. Locking of the terminal block into the cover is provided by ramps 54 along the surface of the cover inner cavity that engage and cooperate with slots 56 on the side of the terminal block 52. As the assembled terminal block is slid fully into place within the cover cavity the ramps 54 are deflected out of the way of the top of terminal block 52 and engage the tops of slots 56 to prevent removal of the cover from the terminal block. The relatively permanent insertion of the terminal bloc into the cover preserves the integrity of the wiring located therein.

Wiring of the terminal block connects the power cord 16 with the wires 12 of the light strings. In the practice of this invention any method can be used to attach the power cord to the light strings within a closed central connection box. The only essential requirements for the wiring and wiring connections at the central connection box is that all wiring extend from the bottom of the central connector box and the connection between the leads be secure and relatively permanent. In this specific embodiment the power cord 16 extends into the center of the terminal block 52 through sleeve 38. Sleeve 38 communicates with a central passageway that extends through the center of the terminal block and directs the power cord to the interior of the terminal block. A supply lead 62 and neutral lead 64 of the power cord are separated and extended to outer faces on opposite sides of the terminal block. Both faces opposing faces of the terminal block are similar in design to face 60 which is shown in FIG. 5 and representative thereof. Face 60 has a labyrinth path through which lead 64 extends. Lead 64 is connected to the all the neutral leads of wires 12 so that half of all the wires in the light strings ar connected through a single connector bus 66. Lead 64 is electrically connected to connector bus 66 by crimping, soldering or any suitable method such as a pin and eye terminal. Passage of the lead 66 through the labyrinth path prevents tension on the power cord from pulling lead 64 away from connector bus 66 and out of the terminal block.

Another face 53 of terminal block 52 opposite to face 60, is shown in FIG. 6. In FIG. 6 the terminal block 52 is removed from the terminal block cover 36. FIG. 6 shows supply lead 62 extending through a having a eye terminal in the form of a ring connector crimped to its end. A post 57 extends outward from face 53 and retains ring connector 55. A fuse in the form of wire 59 electrically connects ring connector 55 with a terminal bus 61. The fuse arrangement on face 53 is of a relatively permanent nature due to the use of the previously described ramps that lock that terminal block into the cover; however it is also possible to design a removal terminal block and use a replaceable fuse within the terminal block.

An especially useful form of connector bus 66, 61 is shown in FIGS. 5 and 6. This type of connector bus extends transversely across the bottom of the terminal block. The transverse length of the connector bus across the bottom of the terminal block allows wires to be spaced across the entire bottom of the terminal block to accommodate a large number of light strings. Slots 68 on opposing ends of the terminal block retain the ends of the connector bus to hold it securely within the terminal block.

Connector bus 66 and connector terminals 70 for the wires 12 are shown in more detail in FIG. 7. The connector bus 66 consists of a long flat plate section 72. A multiplicity of clips 73 are attached to the lower side of the plate 72 and act resiliently against the plate. The clips are spaced apart to provide room for insertion of the connector terminals therebetween. In preferred form, the clips 73 are an integral part of the base material of connector bus 66. In the embodiment of FIG. 7 the clips 73 are cut from the base material of plate 72 and folded over into resilient contact therewith. The terminal bus and clips are formed from a ductile conductive material such as brass. The connector terminal 70 consists of an end plate 76 and a crimp connector 74. Crimp connector 74 electrically and mechanically connects wire 12 to the terminal connector 70. The connection between the wires and the connector bus is made by sliding connector terminal 70 downward so that a crimp connector 74 extends in the gap between the clips 73 and at least the outer edges of plates 76 are held by adjacent clips. FIG. 8 shows a side view of connector bus 66 with the end plate 76 of connector terminal 70 is held between plate section 72 and clips 73. Each connector bus can retain a large number of terminal connectors. For this purpose several terminal connectors can be place on top of each other and retained by the same pair of clips 74. The force of the clips 74 acting against the end plate 76 will in most cases keep the clips firmly secured in the connector bus. If desired, the terminal connectors can be more firmly secured into the connector bus by soldering the plate connectors in place or providing a locking tab (not shown) at the top of the connector bus to hold the terminal connector in place after insertion into the terminal bus.

Following connection of the wires 12 to the connector bus 66, the connector bus is retained, as previously, described in the terminal block 52. When all the wiring is in place the face 60 of the terminal block is covered by a shield 78 as shown in FIG. 9. Each face 60 of the terminal block is covered with a shield before the terminal block is inserted into central connector cover 36. The majority of the shield consists of a flat piece of weather proof and electrically insulting material that fits between the terminal block 52 and the terminal cover 36. The shield is held in place on the cover by a set of slots 80 in the top of shield 78 that cooperate with corresponding lugs 82 on the terminal block 52 that extend outward therefrom. Lugs 82 and slots 80 position the shield such that a lip 84 is disposed at the bottom of the terminal block. When in place on the terminal block, Lip 84 extends inwardly from the outside of the terminal block and aids in enclosing the interior of the central connector box and preserving the connection of wires 12 to the terminal block. An arcuate cut out 86 is provided in lip 84 to cooperate with sleeve 38 when the pair of covers 78 are put in place on the terminal block.

FIG. 10 shows how the arcuate cut outs 86 partially surround sleeve 38 when the central connector is assembled with the shields in place. In the preferred form of this invention lips 84 form a slot 87 through which wires 12 extend out of the central connector box. By having the lip extend inward past the terminal block, the lip 84 provides a bent path for the wires 12 as they extend out of the central connector. This bent path relieves any force that might be placed on terminal connector 70 and the wire jacketing to prevent wires 12 from being pulled out of the central connector.

The description of this invention in the context of the specific embodiment of the drawings is not meant to limit the invention to the details shown therein. The central connector and light arrangement can be designed in variety of ways that utilize the general concepts of this invention and the claims of this invention are meant to encompass all such variations.

I claim:

1. Alighting apparatus for outdoor use in a radially extending pattern, said apparatus comprising:

a) a power supply cord for a central outlet;

b) a plurality of miniature light strings with each string containing at least five miniature lights connected in a series circuit; and, c) a central connection box having means for electrically connecting each of said light strings in parallel with said power supply cord, a cover cooperating with the central connection box, said cover having water impervious sides and a water impervious top, and side channels for collecting said storing a portion of the wire from each string.

2. The lighting apparatus of claim 1 wherein said power cord includes a ground fault circuit interrupt device.

3. A lighting apparatus for outdoor use in a patio umbrella having radially extending ribs for supporting a covering material thereon, said apparatus comprising:

a) a power supply cord for a central outlet;

b) a plurality of miniature light strings with the lights in each string connected in a series circuit;

c) means for securing individual light strings along the length of individual ribs of said umbrella;

d) a central connection box having means for electrically connecting each of said light strings in parallel with said power supply cord and a cover that cooperates with said central connection box, said cover having water impervious sides and a water impervious top; and, e) means for securing said central connection box to a center support for said umbrella.

4. The apparatus of claim 3 wherein said central connection box has an upright position and said power supply cord and said light strings communicate with the interior of said central connection box through the bottom of said central connection box.

5. The apparatus of claim 4 wherein the said central connection box has side channels for collecting and storing a portion of the wire from each string.

6. The apparatus of claim 5 wherein said central connection box includes a pair of connector buses in electrical connection with the leads of said power cord and electrically connected to said light strings.

7. Apparatus of claim 6 wherein said light strings have leads that terminate in plate connectors and said connector bus comprises an elongate conductive strip of resilient material that forms a plurality of spaced apart clips for retaining said plate connectors.

8. Apparatus of claim 7 wherein said central connection box comprises an outer cover, an inner terminal bock retaining said plate connectors, sand means for retaining a terminal end of said power cord within said central connection box.

9. Apparatus of claim 8 wherein said power cord includes a ground fault circuit interrupt device.

10. A patio umbrella arrangement for providing diffuse light comprising:

a) a patio umbrella having a center support, a plurality of ribs extending radially outward from an upper section of said center support, and a covering material supported by said ribs;

b) a string of miniature lights connected in a series circuit, secured to and extending along each rib;

c) a power supply cord for a n electrical outlet; and, d) a central connection box secured to said center support having means for electrically connection each of said light strings in parallel with said power supply cord and a cover that cooperates with said central connection box, said cover having layer impervious sides and a water impervious top.

11. The apparatus of claim 10 wherein said power cord includes a ground fault circuit interrupt device.

12. A lighting apparatus for outdoor use in a radially extending pattern, said apparatus comprising:

a) a power supply word for a central outlet;

b) a plurality of miniature light strings with each string containing at least five miniature lights connected in a series circuit and said light strings having leads that terminate in plate connectors;

c) a central connection box having means for electrically connecting each of said light strings in parallel with said power supply cord and a cover cooperating with said central connection box, said cover having water impervious sides and water impervious top; and, (d) a pair of connector buses in said central connection box arranged in electrical connection with the leads of said power cord and electrically connected to said light strings said connector buses comprising elongate conductive strips of resilient material that form a plurality of spaced apart clips for retaining said plate connectors.

13. The lighting apparatus of claim 12 wherein said central connection box comprises an outer cover, an inner terminal bock retaining said plate connectors, and means for retaining a terminal end of said power cord in said terminal block.

* * * * *